US010196186B2

(12) United States Patent
Cox

(10) Patent No.: US 10,196,186 B2
(45) Date of Patent: Feb. 5, 2019

(54) RECEPTACLE CLOSURE

(71) Applicant: Jeff Cox, Johnstown, OH (US)

(72) Inventor: Jeff Cox, Johnstown, OH (US)

( * ) Notice: Subject to any disclaimer, the term of this patent is extended or adjusted under 35 U.S.C. 154(b) by 128 days.

(21) Appl. No.: 15/506,475

(22) PCT Filed: Sep. 3, 2015

(86) PCT No.: PCT/US2015/048262

§ 371 (c)(1),
(2) Date: Feb. 24, 2017

(87) PCT Pub. No.: WO2016/036919

PCT Pub. Date: Mar. 10, 2016

(65) Prior Publication Data

US 2018/0201416 A1 Jul. 19, 2018

Related U.S. Application Data

(60) Provisional application No. 62/046,190, filed on Sep. 5, 2014.

(51) Int. Cl.
*B65D 47/20* (2006.01)
*B65D 47/12* (2006.01)

(52) U.S. Cl.
CPC ..... *B65D 47/2031* (2013.01); *B65D 47/12* (2013.01); *B65D 2251/08* (2013.01); *B65D 2251/09* (2013.01)

(58) Field of Classification Search
CPC ..... B65D 47/2031; B65D 47/2018; B65D 47/123; B65D 47/122; B65D 47/12; B65D 47/06; B65D 47/046; B65D 47/04; B65D 47/063; B65D 47/061; B65D 47/065; B65D 51/002; B65D 51/00; B65D 51/1644;

(Continued)

(56) References Cited

U.S. PATENT DOCUMENTS 417,393 A * 12/1889 McAllister ..... F16L 33/24 285/40
1,637,326 A * 7/1927 Murphy ..... F16N 3/12 141/353

(Continued)

OTHER PUBLICATIONS

PCT/US15/48262 International Search Report and Written Opinion, 5 pgs.

*Primary Examiner* — Robert J Hicks
(74) *Attorney, Agent, or Firm* — Black, McCuskey, Souers & Arbaugh, LPA

(57) ABSTRACT

A receptacle closure can include a body, an aperture, a first female threaded portion, a second female threaded portion, and a self-sealing valve. The body can extend along a longitudinal axis between a first end and a second end. The aperture can extend through the body between the first end and the second end. The first female threaded portion can extend from the aperture at the first end and can have a first thread configuration. The second female threaded portion can extend from the aperture at the second end and can have a second thread configuration. The first female threaded portion can be spaced from the second female threaded portion along the longitudinal axis. The self-sealing valve can be disposed in the body between the first female threaded portion and the second female threaded portion along the longitudinal axis.

12 Claims, 6 Drawing Sheets

(58) Field of Classification Search
CPC .. B65D 51/165; B65D 51/1633; B65D 51/16; B65D 51/1661; A61J 1/1406
USPC ..... 215/247, 329, 316, 311, 310, 307, 229; 220/367.1, 203.17, 203.16, 203.11, 303, 220/288, 229, 709, 705; 403/109.8, 403/109.1, 377; 138/91; 222/532, 531, 222/526, 529, 528, 527, 537, 514, 513, 222/492, 522
See application file for complete search history.

(56) References Cited

U.S. PATENT DOCUMENTS 1,956,554 A * 5/1934 Baldwin, Jr. ..... B21K 1/24 137/594
2,039,658 A * 5/1936 Paul ..... B65D 47/06 215/227
2,884,148 A * 4/1959 Schneider ..... B65D 41/045 215/329
3,131,716 A * 5/1964 Griswold ..... G01P 13/0013 137/242
3,164,280 A * 1/1965 Ford ..... B65D 77/28 215/309
4,669,791 A * 6/1987 Savill ..... B60T 17/04 439/132
4,717,050 A 1/1988 Wright
4,961,888 A 10/1990 Brown
4,991,745 A 2/1991 Brown
5,033,655 A 7/1991 Brown
5,213,236 A 5/1993 Brown et al.
5,339,995 A 8/1994 Brown et al.
5,377,877 A 1/1995 Brown et al.
5,409,144 A 4/1995 Brown
5,427,275 A 6/1995 Hansen
5,439,143 A 8/1995 Brown et al.
5,730,306 A 3/1998 Costa et al.
6,089,419 A 7/2000 Gross
6,112,926 A 9/2000 Fishman
6,116,458 A 9/2000 Dark
6,478,179 B1 11/2002 Alexander
6,523,711 B1 2/2003 Hughes et al.
6,783,019 B2 8/2004 Zettle et al.
6,942,121 B1 9/2005 Northup et al.
7,308,988 B2 12/2007 Yashima et al.
7,784,652 B2 8/2010 Gaus et al.
8,016,507 B2 9/2011 Wright
8,079,385 B2 12/2011 Hatton
8,302,770 B2 11/2012 Valentine
2003/0168455 A1 9/2003 Zettle et al.
2010/0012193 A1* 1/2010 Anson ..... B65D 47/243 137/1
2010/0282751 A1 11/2010 Quirijnen
2014/0034523 A1 2/2014 Valentine
2014/0054330 A1 2/2014 Feriani et al.
2014/0151322 A1 6/2014 Bahri et al.

* cited by examiner

RECEPTACLE CLOSURE

CROSS-REFERENCE TO RELATED APPLICATIONS

This application claims the benefit of U.S. Provisional Patent Application Ser. No. 62/046,190 for a RECEPTACLE ENCLOSURE, filed on Sep. 5, 2014, which is hereby incorporated by reference in its entirety.

BACKGROUND

1. Field

The present disclosure relates to an closure for a receptacle such as a cap that can selectively close a bottle.

2. Description of Related Prior Art

U.S. Pat. No. 6,116,458 discloses a SPORT DRINKING CUP WITH VALVED STRAW CAP. The cap is formed by a pivotable drinking spout and diaphragm arrangement in a cap base. The drinking spout that forms the mouthpiece on the upper side of the diaphragm through which the user sucks liquid, contains a portion on the underside the diaphragm. That lower spout portion carries an elastic hose or tube for immersion in the bottle's liquid when the drinking spout is in the open position, whereby the series of passages through the elastic tube and drinking spout serves as a straw. When the spout is pivoted to its closed position and latched, in one movement, the lower portion of the spout swings a portion of the elastic tube against the vent, closing the vent, and forces another portion of that hose into an interference surface, creating a bend or kink in the hose that prevents liquid passage.

SUMMARY

A receptacle closure can include a body, an aperture, a first female threaded portion, a second female threaded portion, and a self-sealing valve. The body can extend along a longitudinal axis between a first end and a second end. The aperture can extend through the body along the longitudinal axis between the first end and the second end. The first female threaded portion can extend from the aperture at the first end and can have a first thread configuration. The second female threaded portion can extend from the aperture at the second end and can have a second thread configuration. The first female threaded portion can be spaced from the second female threaded portion along the longitudinal axis. The first thread configuration can have a different thread size than the second thread configuration. The self-sealing valve can be disposed in the body between the first female threaded portion and the second female threaded portion along the longitudinal axis.

BRIEF DESCRIPTION OF THE DRAWINGS

The detailed description set forth below references the following drawings.

DETAILED DESCRIPTION OF AN EXEMPLARY EMBODIMENT

The invention, as demonstrated by the exemplary embodiment described below, provides an closure for a receptacle, such a bottle. The embodiment disclosed below can be useful in allowing a user of the receptacle to draw the contents of the receptacle without removing the closure. Embodiments of the present disclosure can be used with commercially-sold beverages including soda, water and juice.

Figure 5:
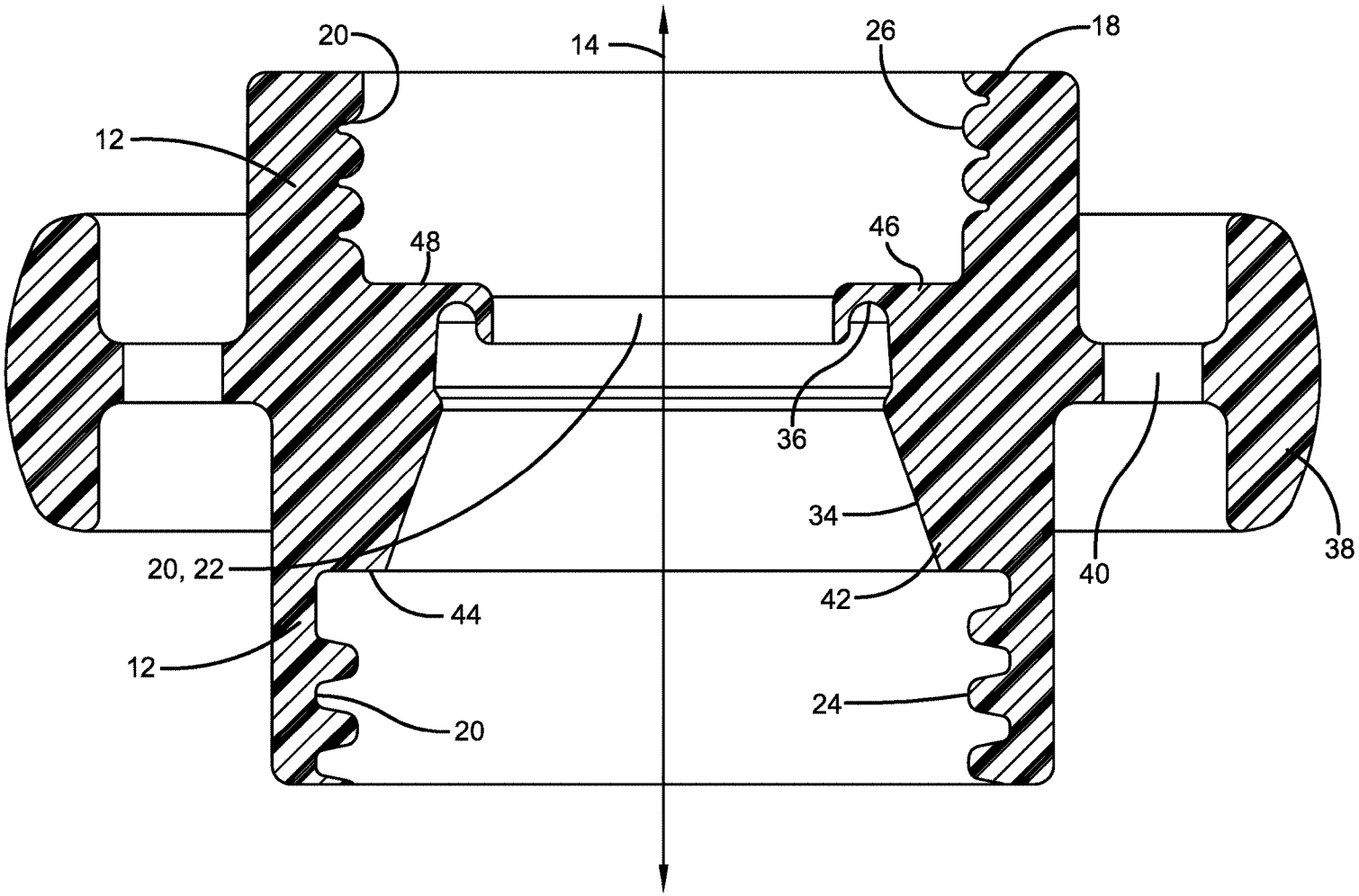
FIG. 5 is a cross-sectional view taken through section lines 5-5 in FIG. 4.
Figure 6:
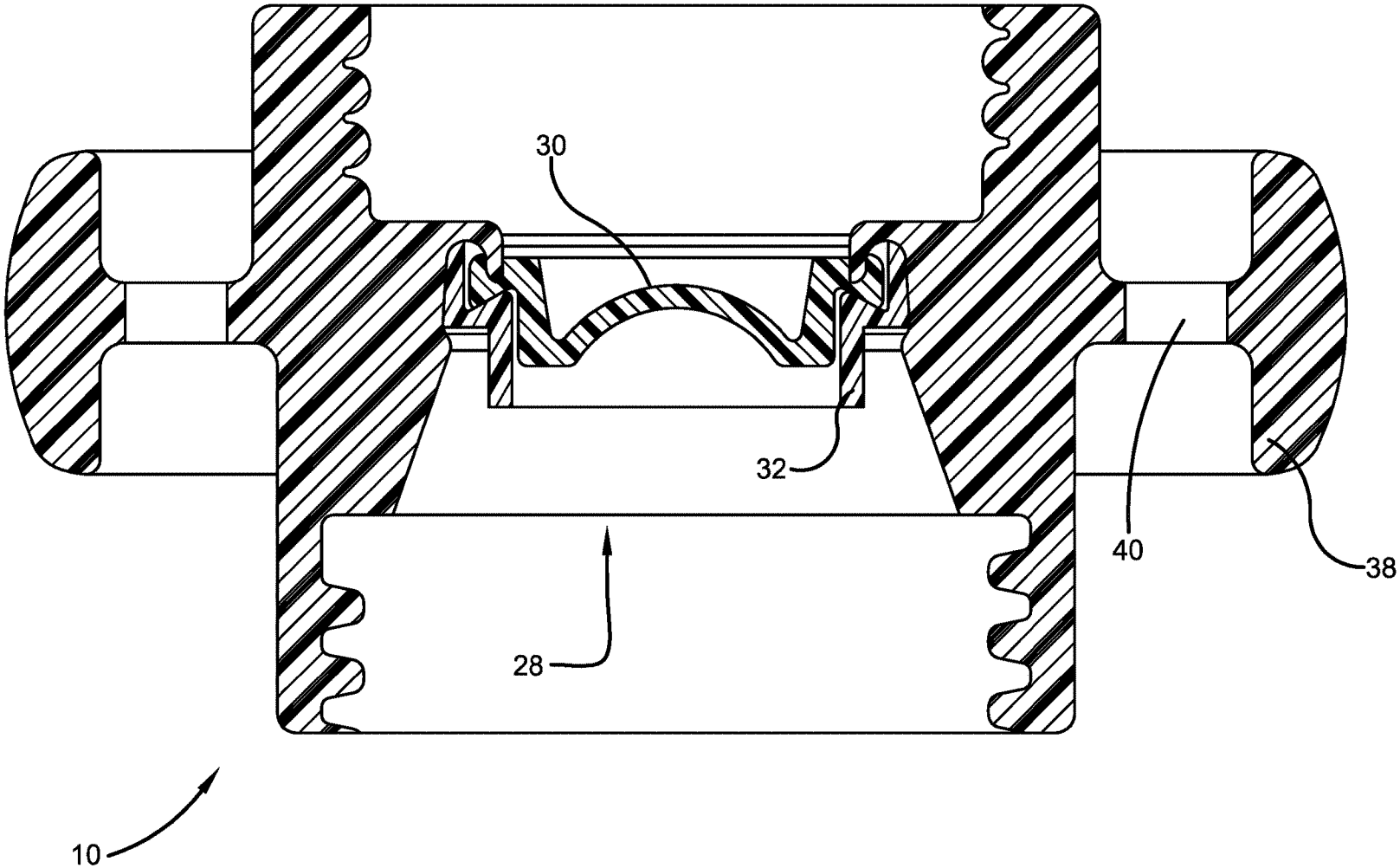
FIG. 6 is a cross-sectional view similar to FIG. 5 and also showing a self-sealing valve.

A receptacle closure 10, referenced in FIG. 6, can be constructed in accordance with an exemplary embodiment of the present disclosure. The receptacle closure 10 can include a body 12 extending along a longitudinal axis 14, both referenced in FIGS. 1-5. The body 12 can extend between a first end 16 and a second end 18.

The receptacle closure 10 can also include an aperture 20 extending through the body 12. The aperture 20 can extend along the longitudinal axis 14 between the first end 16 and the second end 18. The exemplary aperture 20 can include a plurality of different diameters between the first end 16 and the second end 18.

The receptacle closure 10 can also include an aperture 20 extending through the body 12. The aperture 20 can extend along the longitudinal axis 14 between the first end 16 and the second end 18. The exemplary aperture 20 can include a plurality of different diameters between the first end 16 and the second end 18. A portion 22 of the aperture 20 can define a minimum diameter of the aperture 20.

The receptacle closure 10 can also include a first female threaded portion 24. The first female threaded portion 24 can extend from the aperture 20 at the first end 16. The first female threaded portion 24 can have a first thread configuration. The first thread configuration can be a right-hand thread, single start, 650° turn of depth, with a 2.70 millimeter thread pitch. The first thread configuration can be the industry standard used on carbonated beverage bottles from sixteen ounce, up to two liter.

The receptacle closure 10 can also include a second female threaded portion 26. The second female threaded portion 26 can extend from the aperture 20 at the second end 18. The first female threaded portion 24 can be spaced from the second female threaded portion 26 along the longitudinal axis 14. The second female threaded portion 26 can have a second thread configuration. The first thread configuration can be different than the second thread configuration. The second thread configuration can be a low-profile, three-start thread, such as is typically used on water bottles.

As shown in FIG. 6, the receptacle closure 10 can also include a self-sealing valve 28 disposed in the body 12 between the first female threaded portion 24 and the second female threaded portion 26 along the longitudinal axis 14. The valve 28 can include a valve sealing member 30 and a valve frame member 32. The valve sealing member 30 can be mounted on the valve frame member 32. One kind of self-sealing valve that can be incorporated in one or more embodiments of the present disclosure is also used in condiment bottles. U.S. Pub. No. 2003/0168455 and U.S. Pat. No. 6,783,019 are hereby incorporated by reference for the disclosure of a supplier for a valve sealing member. Referring additionally to FIG. 5, the body 12 can include a tapered portion 34 for facilitating the insertion of the valve 28 and an annular groove 36 for receiving the valve 28.

The receptacle closure 10 can be formed from plastic. All of the structures associated with the receptacle closure 10 can be integrally-formed with respect to one another. "Integrally-formed" refers to the fact that in the exemplary embodiment the various structures are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

Figure 1:
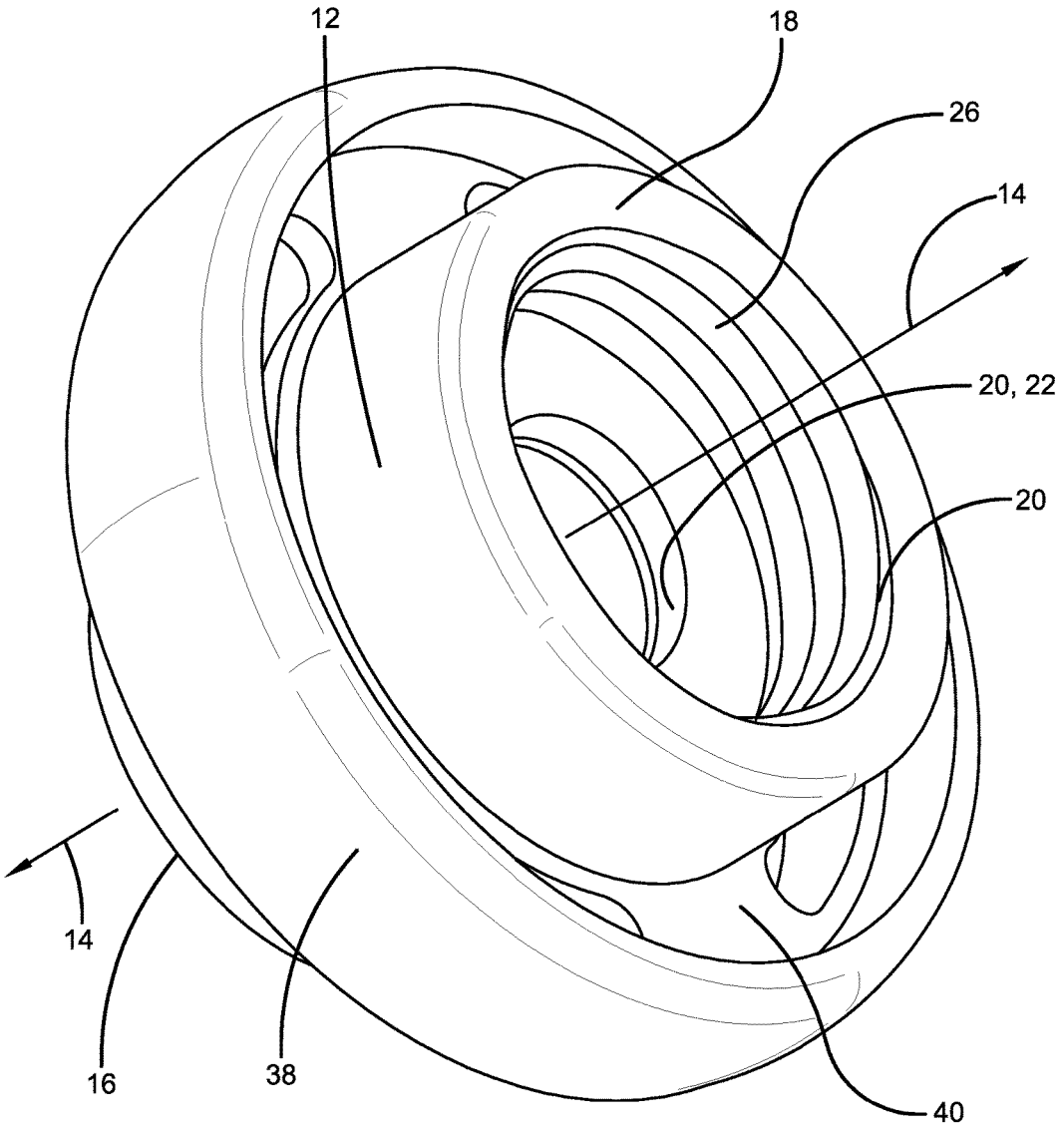
FIG. 1 is a first perspective view of a receptacle closure constructed in accordance with an exemplary embodiment of the present disclosure.
Figure 2:
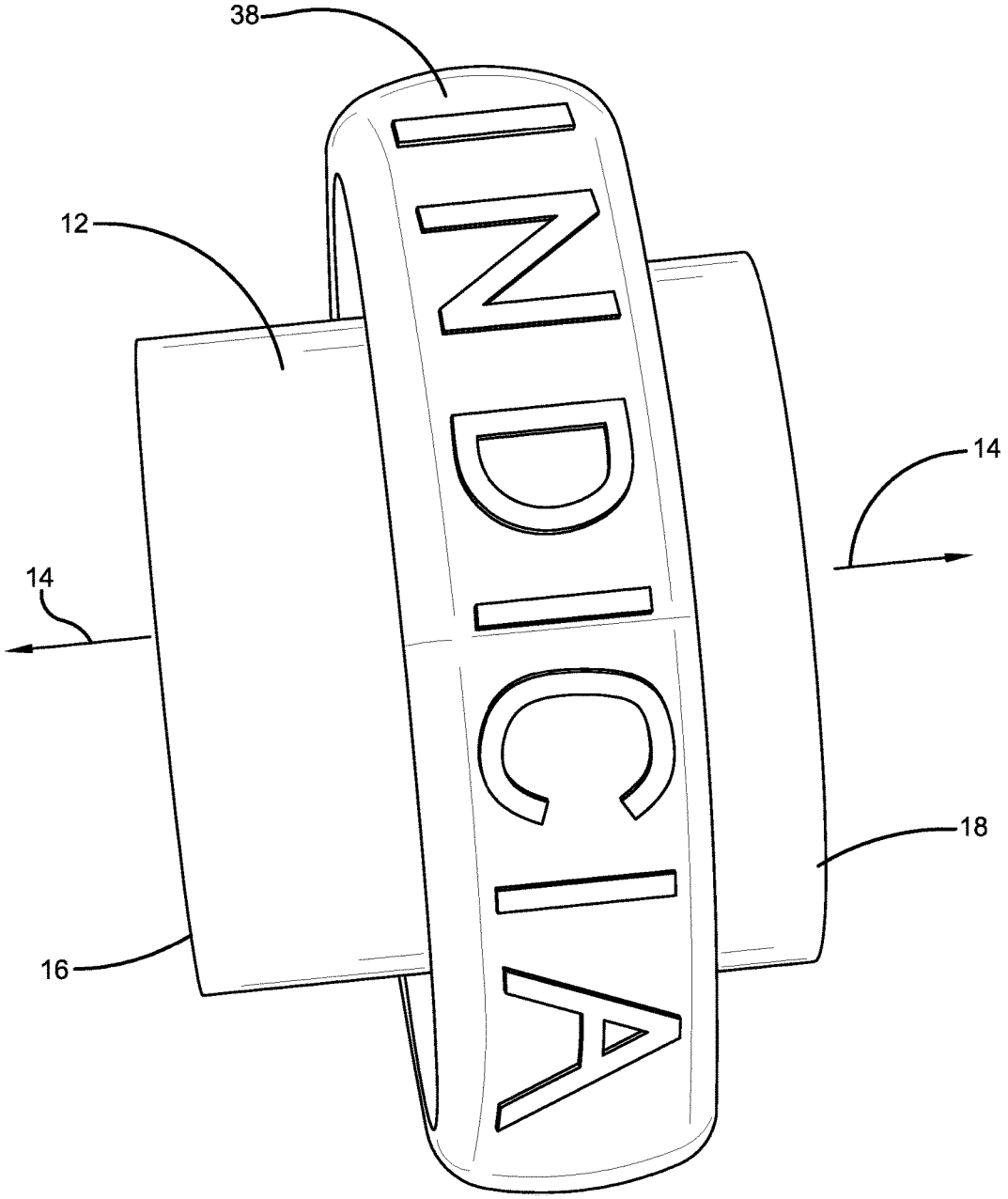
FIG. 2 is a second perspective view of a side of the receptacle closure shown in FIG. 1.
Figure 3:
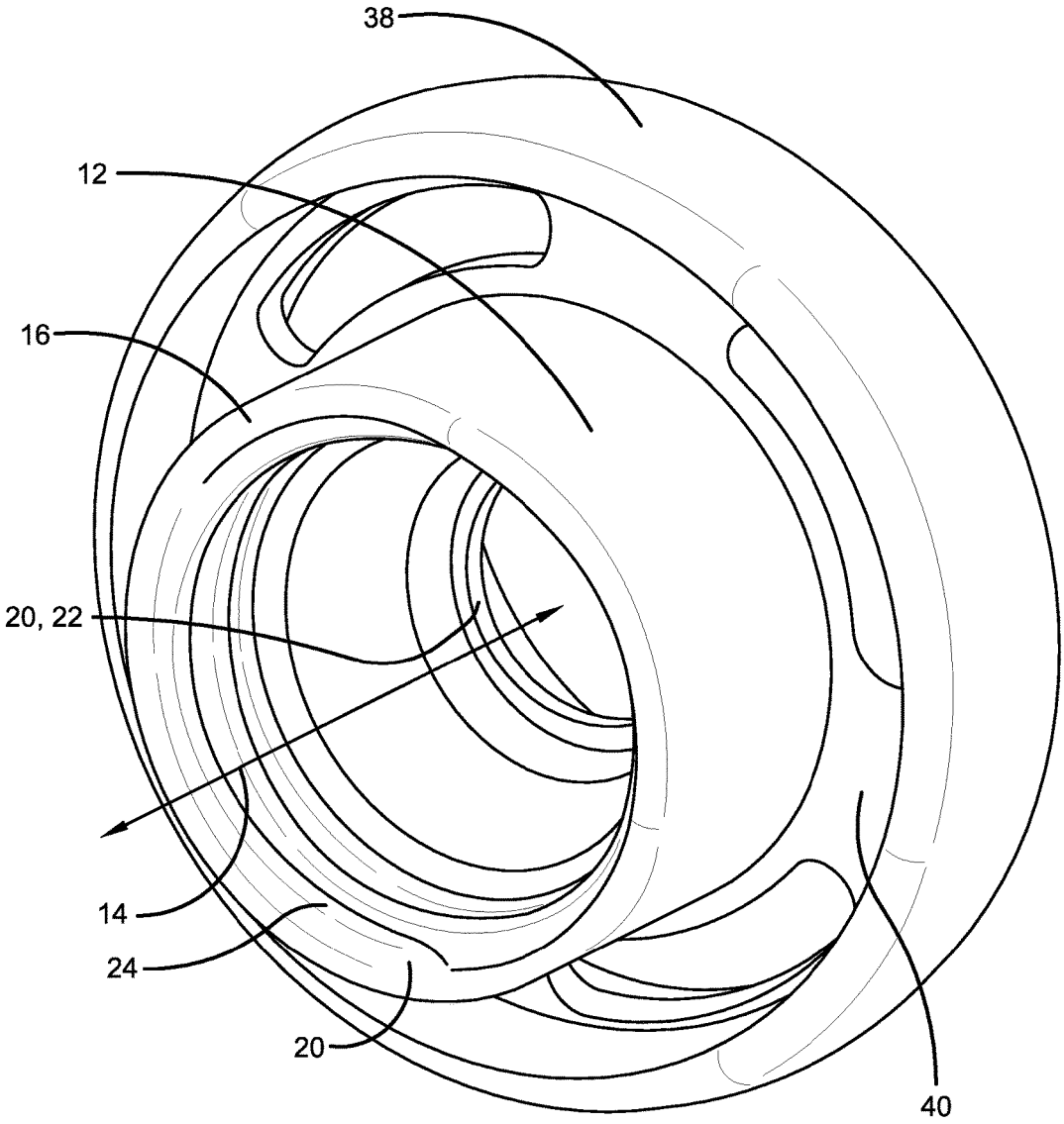
FIG. 3 is a third perspective view of the receptacle closure shown in FIGS. 1-2.
Figure 4:
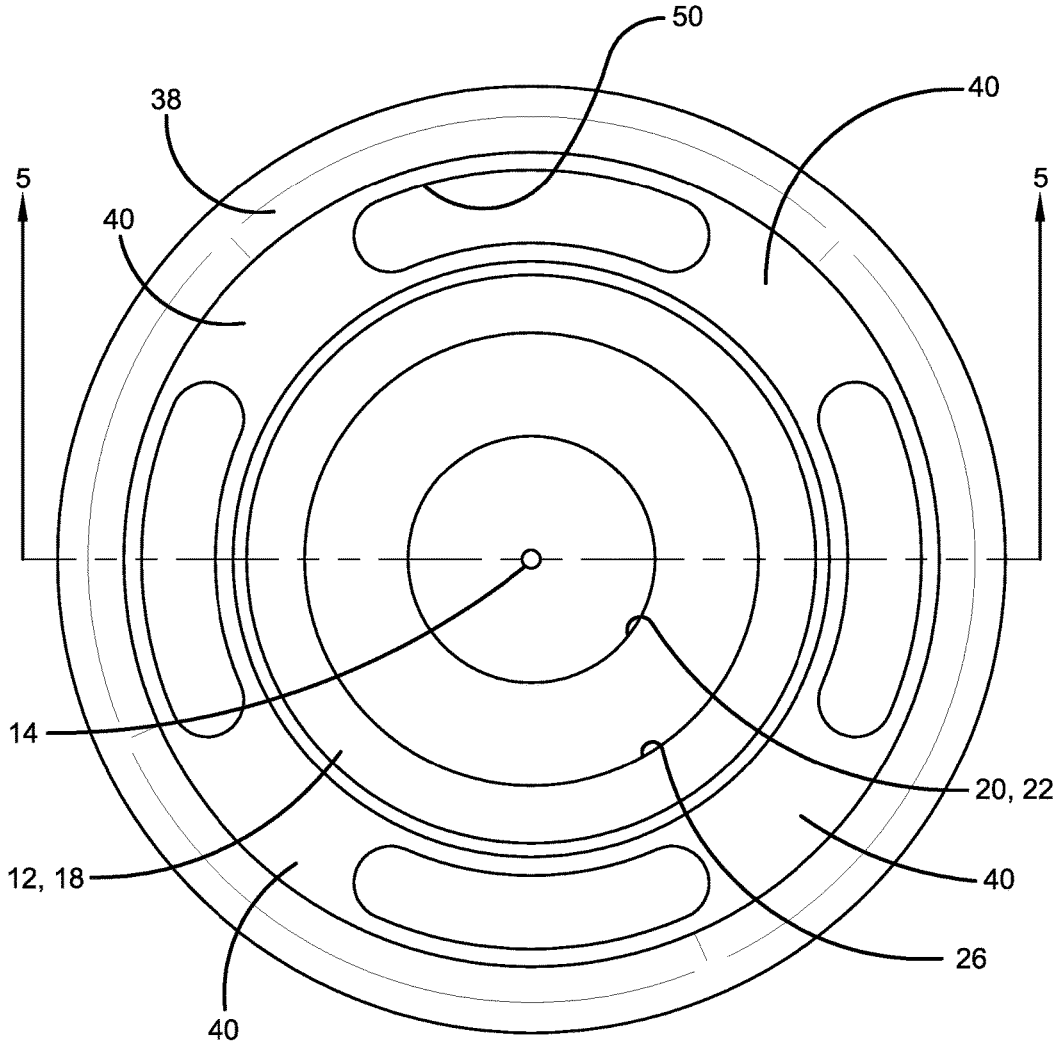
FIG. 4 is a top view the receptacle closure shown in FIGS. 1-3.

The exemplary receptacle closure 10 can include a ring 38 encircling and spaced from the body 12. A plurality of webs, such as web 40, can interconnect the ring 38 and the body 12. The plurality of webs can extend radially outward from the body 12 and interconnecting the ring 38 and the body 12. The webs 40 can be spaced from one another about a periphery of the body 12, as best shown in FIG. 4. The ring 38 can be useful in attaching the receptacle closure 10 on a receptacle such as bottle of soda, water, juice, or any other beverage. The ring 38 can be grasped by user when the receptacle closure 10 is being mounted on a receptacle. Slots, such as slot 50, can be defined between the webs 40 to allow liquid to drain between the webs 40.

The ring 38 can also define a place to display indicia. Indicia can be positioned on the ring 38. The indicia can be integrally molded and raised alphanumeric characters. Alternatively, the indicia can be defined as printed alphanumeric characters. Alternatively, the indicia can be a graphic symbol.

The aperture 20 can define a first shoulder 42 at one end of the first female threaded portion 24. The first shoulder 42 can define a sealing surface 44. The aperture 20 can also define a second shoulder 46 at one end of the second female threaded portion 26. The second shoulder 46 can define a sealing surface 48. Bottles or other containers can seal against the surfaces 44, 48.

In one exemplary operation, a user can replace a cap of a soda bottle by rotating the receptacle closure 10 on the soda bottle, engaging the threads on the bottle with the first female threaded portion 24, wherein the bottle can seal against the surface 44. The user can then pierce the valve sealing member 30 with a straw and consume the beverage in the soda bottle. Alternatively, the user can tip and squeeze the soda bottle to receive the beverage or can suck the beverage out the soda bottle. When the drinking of the beverage is suspended, the valve sealing member 30 can reseal and prevent the beverage from escaping the soda bottle. After the beverage is consumed, the user can remove the receptacle closure 10 from the soda bottle by disengaging the first female threaded portion 24 from the threads on the bottle. The user can then mount the receptacle closure 10 on another receptacle, such as a water bottle. The user can replace a cap of the water bottle by rotating the receptacle closure 10 on the water bottle, engaging the threads on the water bottle with the second female threaded portion 26, wherein the bottle can seal against the surface 48. The user can then pierce the valve sealing member 30 with a straw and consume the water in the water bottle. Alternatively, the user can tip and squeeze the water bottle to receive the water or can suck the water out the soda bottle. When the drinking of the water is suspended, the valve sealing member 30 can reseal and prevent the water from escaping the water bottle.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A receptacle closure comprising:

a body extending along a longitudinal axis between a first end and a second end;

an aperture extending through said body along said longitudinal axis between said first end and said second end;

a first female threaded portion extending from said aperture at said first end and having a first thread configuration;

a second female threaded portion extending from said aperture at said second end and having a second thread configuration, said first female threaded portion spaced from said second female threaded portion along said longitudinal axis and said first thread configuration having a different thread size than said second thread configuration; and a self-sealing valve disposed in said body between said first female threaded portion and said second female threaded portion along said longitudinal axis, said self-sealing valve preventing fluid from passing through said aperture between said first end and second end and selectively pierceable with a straw and resealable after the straw is removed.

2. The receptacle closure of claim 1 wherein said aperture defines a first shoulder at one end of said first female threaded portion.

3. The receptacle closure of claim 2 wherein said first shoulder defines a sealing surface.

4. The receptacle closure of claim 3 wherein said aperture defines a second shoulder at one end of said second female threaded portion.

5. The receptacle closure of claim 4 wherein said second shoulder defines a sealing surface.

6. The receptacle closure of claim 1 further comprising:

a ring encircling and spaced from said body.

7. The receptacle closure of claim 6 further comprising:

a plurality of webs extending radially outward from said body and interconnecting said ring and said body.

8. The receptacle closure of claim 7 wherein said webs are spaced from one another about a periphery of said body.

9. The receptacle closure of claim 8 wherein slots are defined between said webs to allow liquid to drain between said webs.

10. The receptacle closure of claim 7 further comprising:

indicia positioned on said ring.

11. The receptacle closure of claim 10 wherein said indicia is further defined as integrally molded and raised alphanumeric characters.

12. The receptacle closure of claim 10 wherein said indicia is further defined as printed alphanumeric characters.

* * * * *